US008973516B2

(12) United States Patent
Hancock

(10) Patent No.: US 8,973,516 B2
(45) Date of Patent: Mar. 10, 2015

(54) PNEUMATIC SIGNALING DEVICE FOR SCUBA DIVERS

(71) Applicant: David A. Hancock, Seattle, WA (US)

(72) Inventor: David A. Hancock, Seattle, WA (US)

( * ) Notice: Subject to any disclaimer, the term of this patent is extended or adjusted under 35 U.S.C. 154(b) by 296 days.

(21) Appl. No.: 13/648,926

(22) Filed: Oct. 10, 2012

(65) Prior Publication Data

US 2013/0269590 A1 Oct. 17, 2013

Related U.S. Application Data

(60) Provisional application No. 61/627,305, filed on Oct. 11, 2011.

(51) Int. Cl.
*G08B 3/06* (2006.01)
*G10K 9/04* (2006.01)
*B63C 11/26* (2006.01)

(52) U.S. Cl.
CPC .. *G08B 3/06* (2013.01); *B63C 11/26* (2013.01)
USPC ..... 116/142 FP; 116/142 R; 116/137 R

(58) Field of Classification Search
CPC ..... B06B 1/18; B06B 1/183; B63C 11/26; G08B 3/06; G10K 1/06; G10K 1/068; Y10S 116/07; Y10S 116/44
USPC ..... 116/DIG. 7, DIG. 44, 27, 38, 137 R, 140, 116/142 FP, 142 R; 137/625; 181/120; 367/141; 405/186; 441/89
See application file for complete search history.

(56) References Cited

U.S. PATENT DOCUMENTS 6,578,511 B1 * 6/2003 Dexter et al. ..... 116/137 R
6,796,265 B1 * 9/2004 Dexter et al. ..... 116/137 R

* cited by examiner

*Primary Examiner* — Daniel S Larkin
*Assistant Examiner* — Irving A Campbell
(74) *Attorney, Agent, or Firm* — Jensen & Puntigam, PS

(57) ABSTRACT

The audible alarm device comprises a coupling assembly, a chamber assembly and an air horn assembly, releasably separable from each other. The coupling assembly and the chamber assembly are movable by squeezing action so that in one relative position pressurized air from an air inlet in the coupling assembly is allowed through a valve assembly into an interior chamber in the chamber assembly, the air driving a bi-stable piston into repeated contact with a percussion diaphragm, producing a below surface audible sound. An exhaust passage permits air to pass from the interior chamber to the surrounding environment. When the coupling assembly and the chamber assembly are moved by diver action to a second relative position, the exhaust passage is blocked, forcing air in the interior chamber to exhaust to the air horn assembly, which produces an audible sound above the water surface.

9 Claims, 15 Drawing Sheets

PNEUMATIC SIGNALING DEVICE FOR SCUBA DIVERS

TECHNICAL FIELD

This invention relates generally to audible signaling devices for divers, and more particularly to such signaling devices which can produce an effective signal both above the surface of the water and below the surface of the water.

BACKGROUND OF THE INVENTION

Scuba divers in the past have typically relied on either pneumatic surface signaling devices or pneumatic sub-surface signaling devices to attract the attention of others, both above and below the surface of the water. More recently, signaling devices such as shown in U.S. Pat. No. 6,796,265 have included in one device both surface and sub-surface elements with two separate activation arrangements, or an additional element which is capable of diverting air under pressure in the device to either the sub-surface signaling element or to the surface signaling element.

It is desirable, however, to have a signaling device which can redirect air under pressure between a sub-surface signaling element to a surface signaling element, without the need for two separate control members. Such a combined device, however, must still be able to audibly signal divers underwater and others above the surface of the water.

SUMMARY OF THE INVENTION

Accordingly, the audible alarm device for divers, comprising: a coupling assembly having an inlet for connecting to a source of air from a diver's air tank, the coupling assembly further including an air valve which when operated permits air under pressure to move from an outlet in the coupling assembly through a valve channel; and a chamber assembly having an internal chamber, an opening to the internal chamber to receive the valve channel of the coupling assembly, a bi-stable piston and a percussion diaphragm mounted to the internal chamber, the chamber assembly having an exhaust channel which connects the internal chamber to the exterior of the device, wherein when the coupling assembly and the chamber assembly are moved to a first relative position, the air valve is opened, allowing air to move into the internal chamber of the chamber assembly, acting on the bi-stable piston to produce an underwater sound, and wherein when the coupling assembly and the chamber assembly are moved to a second, closer relative position, the exhaust channel is blocked, forcing the air in the internal chamber into air passages leading to a horn assembly which includes a horn diaphragm which produces an above surface noise in response to the air from the internal chamber when the device is above surface.

BEST MODE FOR CARRYING OUT THE INVENTION

Figure 1:
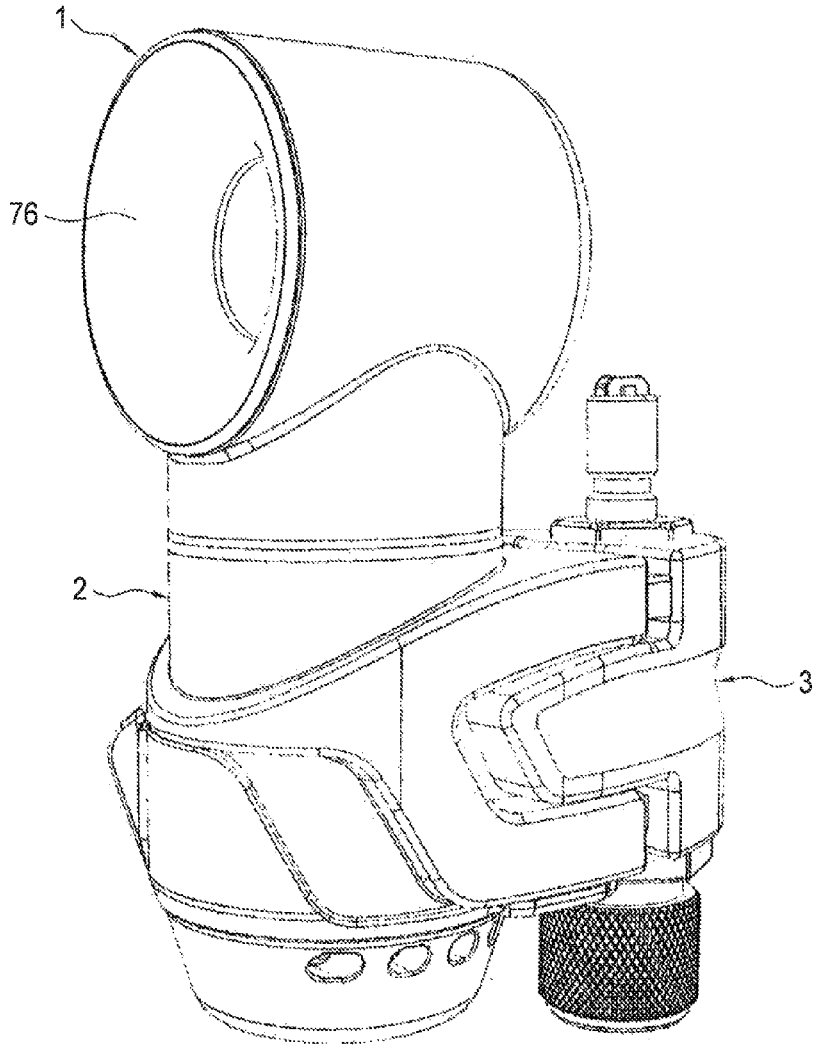
FIG. 1 is a perspective view of the present invention.

Referring now to the invention in more detail, in FIG. 1 there is shown a surface audible housing element 1, a sub-surface audible housing element 2 and an air coupling adapter integration element 3. These three elements are modular and easily separated from each other so as to be more easily assembled and serviced when necessary.

Figure 2:
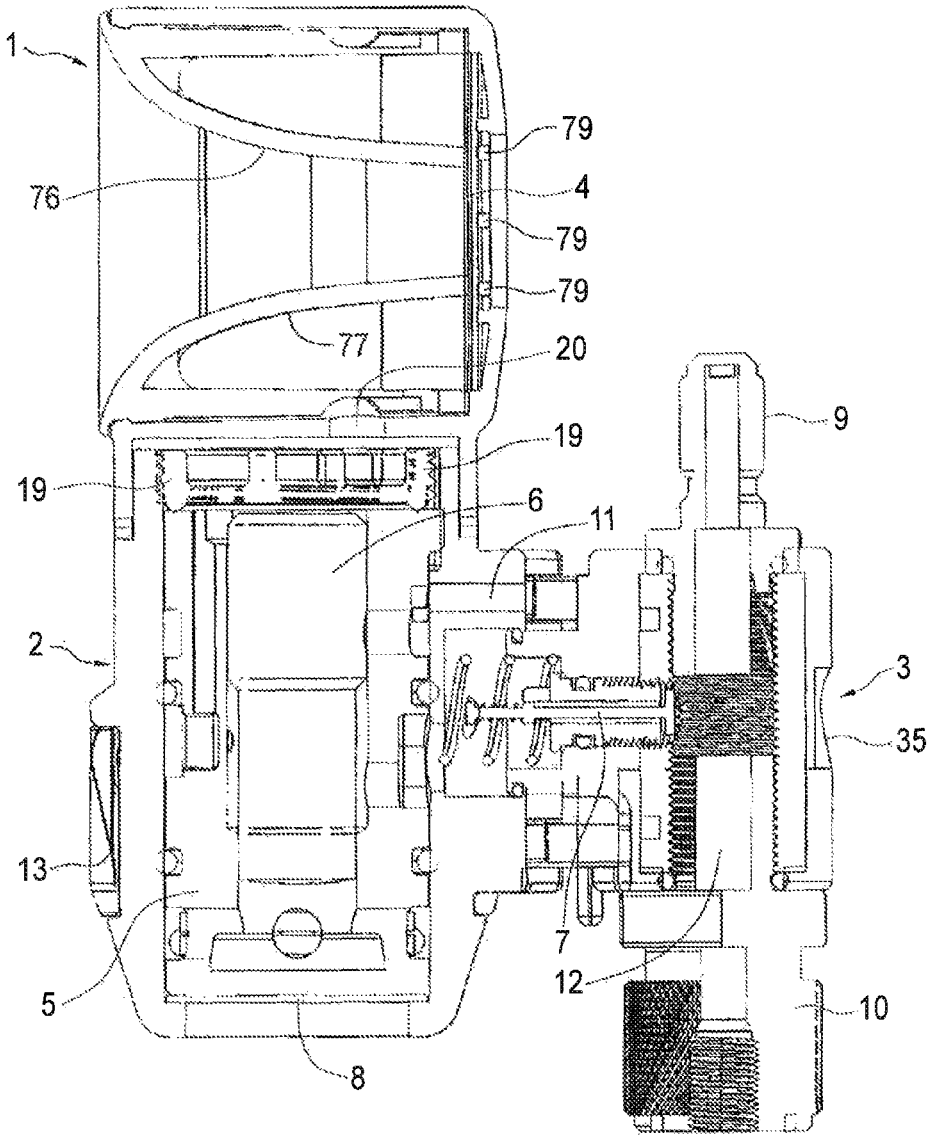
FIG. 2 is a side section view of the present invention.

Referring now to the invention in more detail shown in side section, FIG. 2, there is shown a surface horn diaphragm 4, a chamber 5 for a bi-stable piston 6, a valve 7, an impact underwater percussion diaphragm 8, a male air coupling 9, a female air coupling 10, an exhaust air passage 11, air under pressure pass-through 12 and a locking ring 13 to avoid accidental activation.

Figure 3:
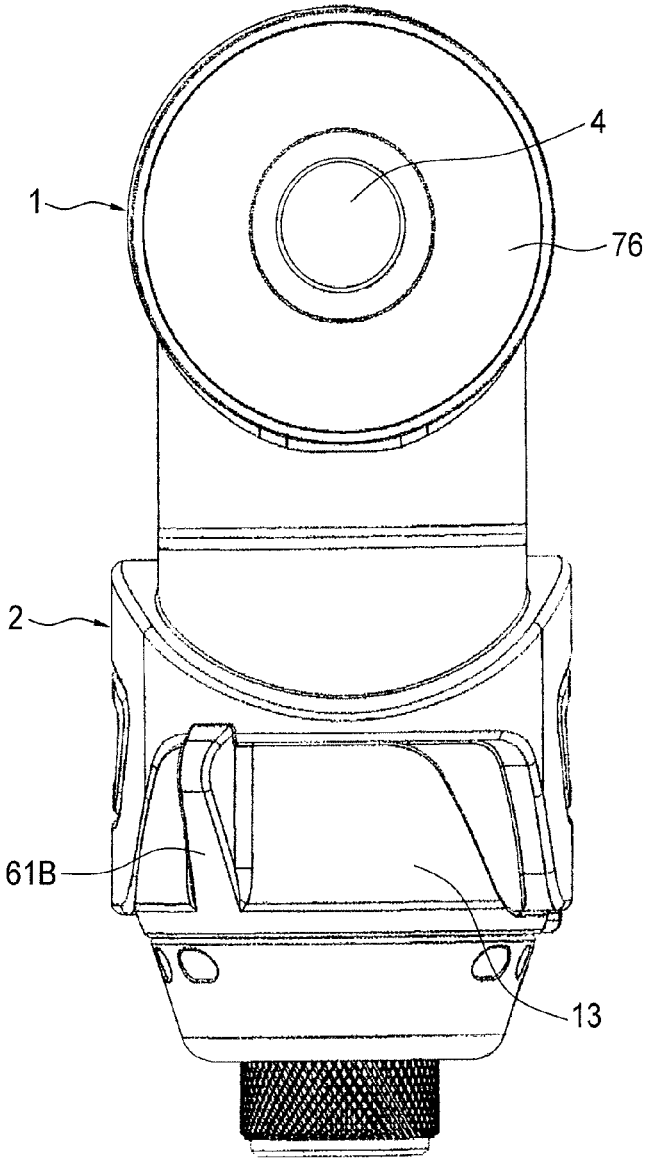
FIG. 3 is a front side view of the present invention.

Referring now to the invention in more detail shown in side section, FIG. 3, there is shown a front side view showing a surface audible housing element 1, a sub-surface audible housing element 2 and a locking ring 13 to avoid accidental actuation.

Figure 4:
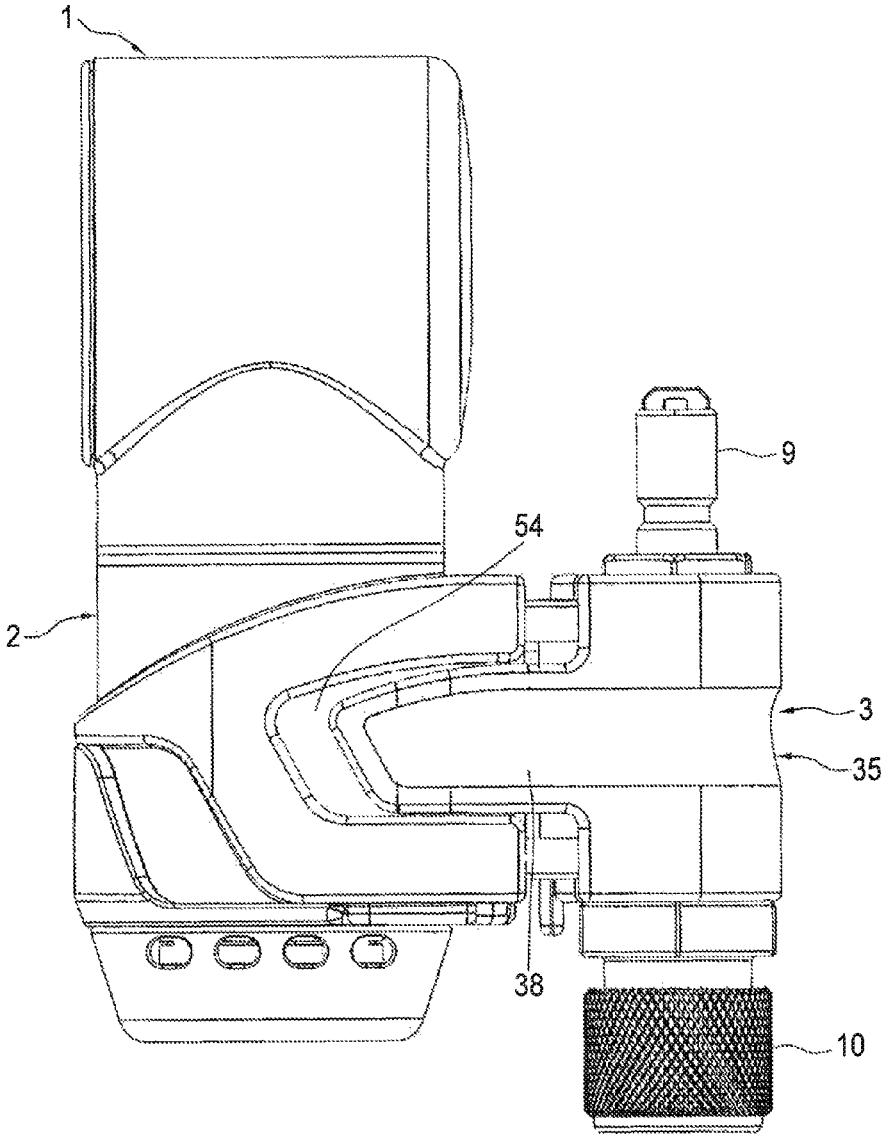
FIG. 4 is a side view of the present invention.

Referring now to the invention in more detail, in FIG. 4 there is shown a side view showing a surface audible housing element 1, a sub-surface audible housing element 2 and an air coupling adapter integration element 3.

Figure 5:
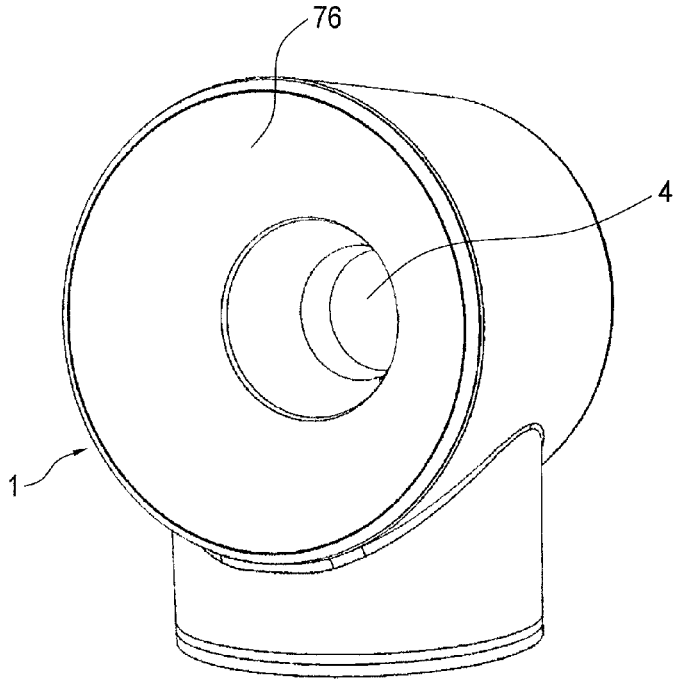
FIG. 5 is a perspective view of the horn housing assembly of the present invention.

Referring now to the invention in more detail, in FIG. 5 there is shown a perspective of a surface audible horn housing element 1 detached from other previously mentioned elements.

Figure 6:
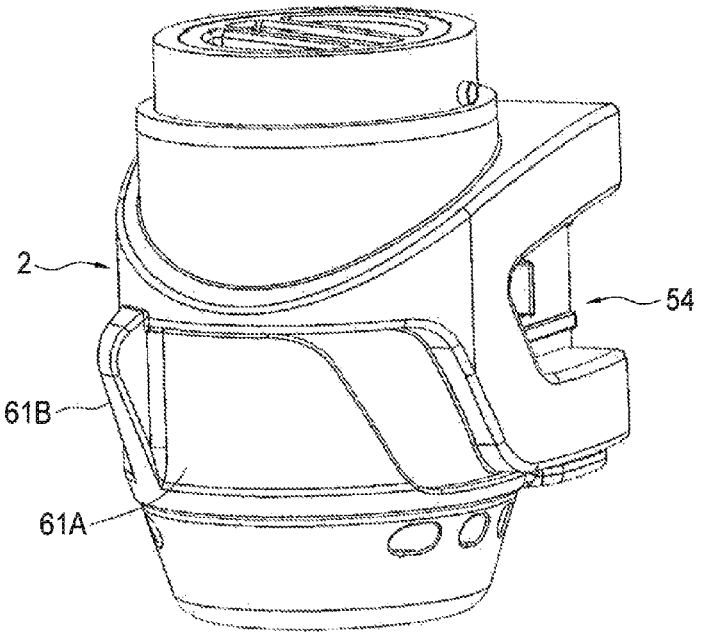
FIG. 6 is a perspective view of the chamber housing assembly of the present invention.

Referring now to the invention in more detail, in FIG. 6 there is shown a sub-surface audible chamber housing element 2 detached from other previously mentioned elements.

Figure 7:
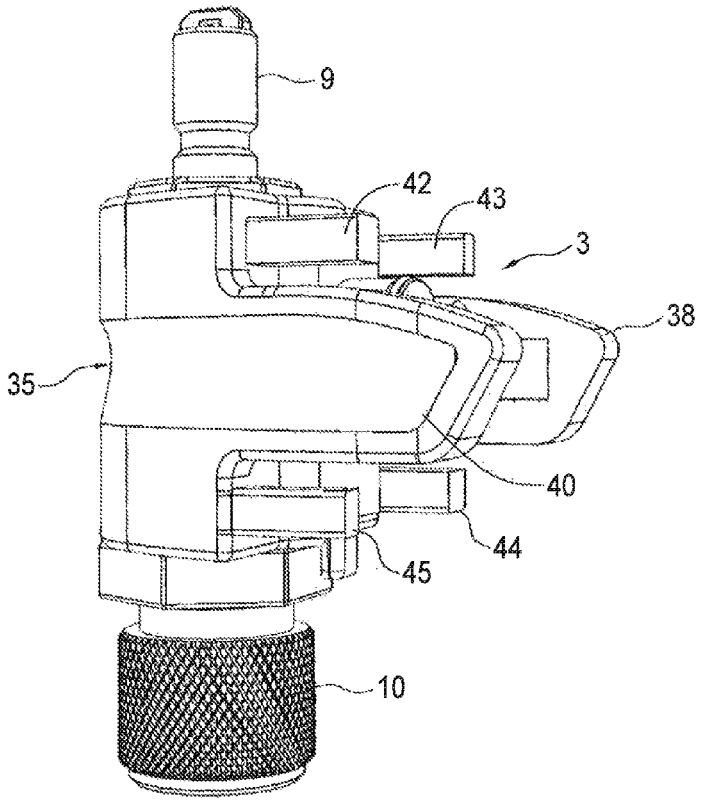
FIG. 7 is a perspective view of the coupling housing assembly of the present invention.

Referring now to the invention in more detail, in FIG. 7 there is shown a coupler housing element 3 detached from other previously mentioned elements.

Figure 8:
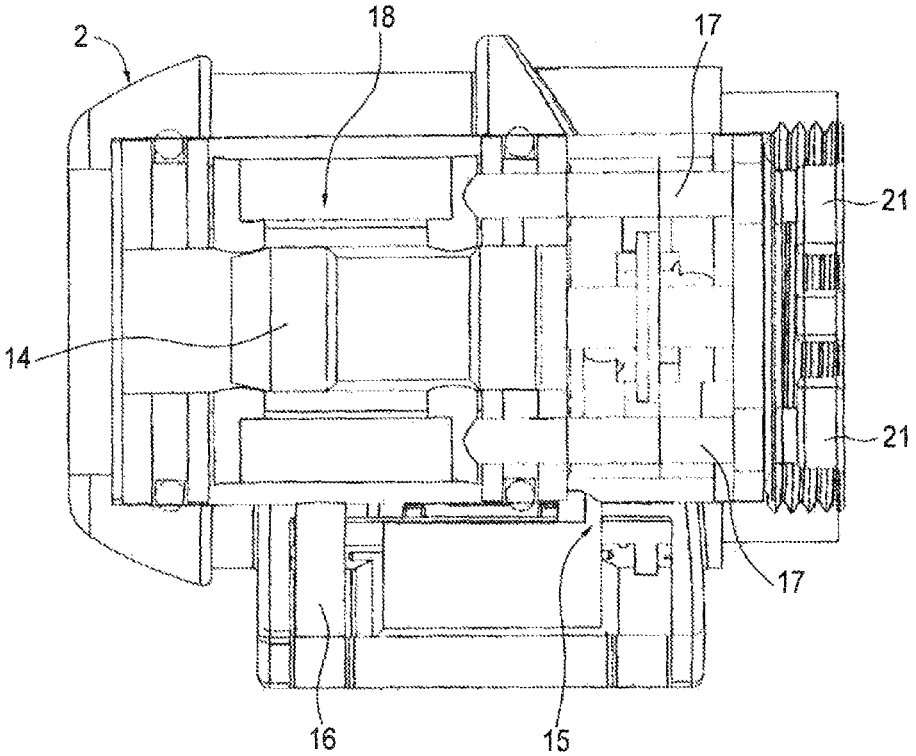
FIG. 8 is a side section detail of an alternate configuration of the chamber housing and chamber of the present invention.

Referring now to the invention in more detail, in FIG. 8 there is shown a side section of an alternate configuration of the chamber housing element 2 with chamber assembly 18, bi-stable piston 14, air under pressure inlet port 15, exhaust air port 16, and additional dual exhaust air ports 17. Dual exhaust air ports 17 are in fluid communication with dual exhaust ports 21 which are in fluid communication with horn housing causing surface horn diaphragm 4 to move and create loud horn noise, as shown in FIG. 2.

Figure 9:
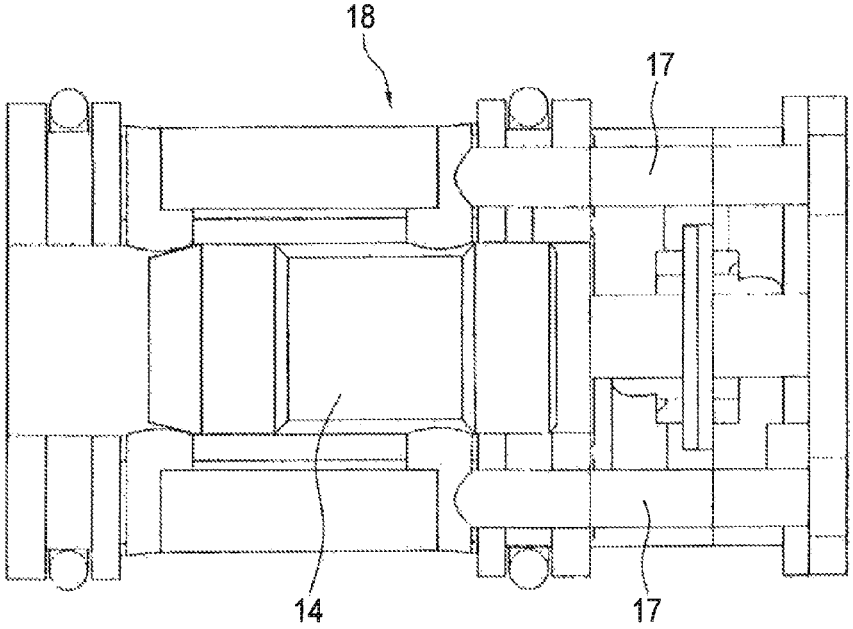
FIG. 9 is a side section detail of an alternate configuration of the chamber and piston of the present invention.

Referring now to the invention in more detail, in FIG. 9 there is shown a side section of an alternate configuration of the chamber assembly 18, bi-stable piston 14, and dual exhaust air ports 17.

Further, the invention is selectively activated when chamber housing element 2 and coupler housing element 3, as shown in FIG. 4, are selectively squeezed together in the scuba diver's hand to open valve 7 to release air under pressure from pass-through 12, allowing fluid communication into chamber housing 5 to activate bi-stable piston 6, thus causing it to rapidly strike percussion diaphragm 8, as shown in FIG. 2.

Further, it should be noted that as chamber housing element 2 and coupler housing element 3, as shown in FIG. 4, are selectively squeezed together harder, exhaust air passage 11 is blocked, and exhaust air under pressure is forced more completely through exhaust air passage 19 and then through exhaust air passage 20 into horn housing 1, causing surface horn diaphragm 4 to move rapidly, thus creating loud horn noise, as shown in FIG. 2.

Figure 10:
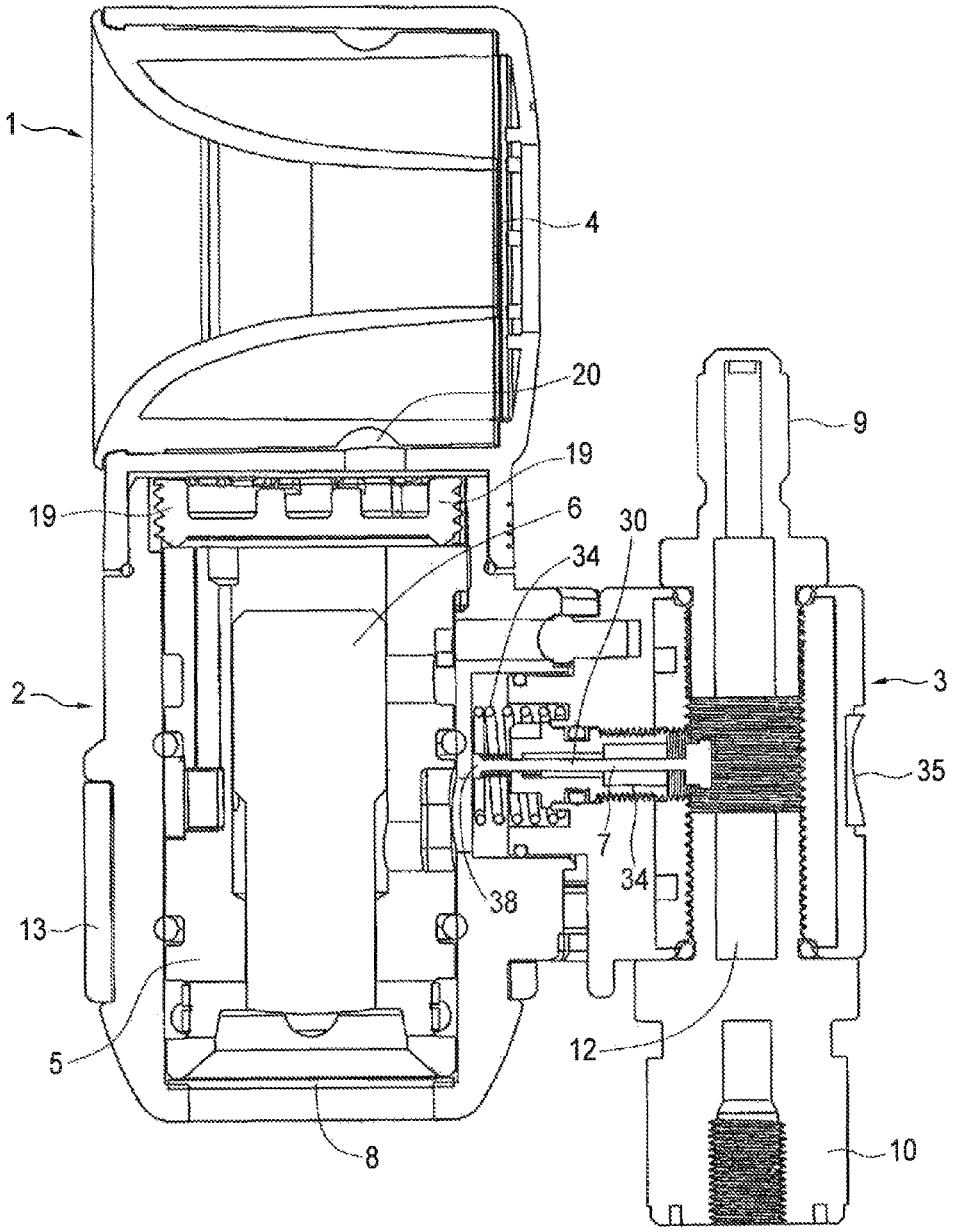
FIG. 10 is another side section view of the present invention.
Figure 11:
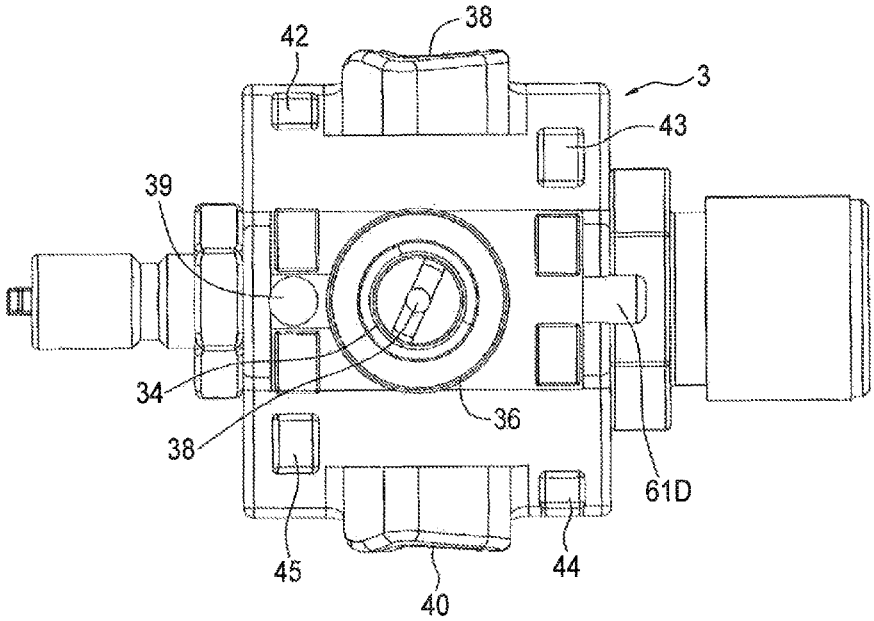
FIG. 11 is another top plan view of the coupling housing assembly of the present invention.
Figure 12:
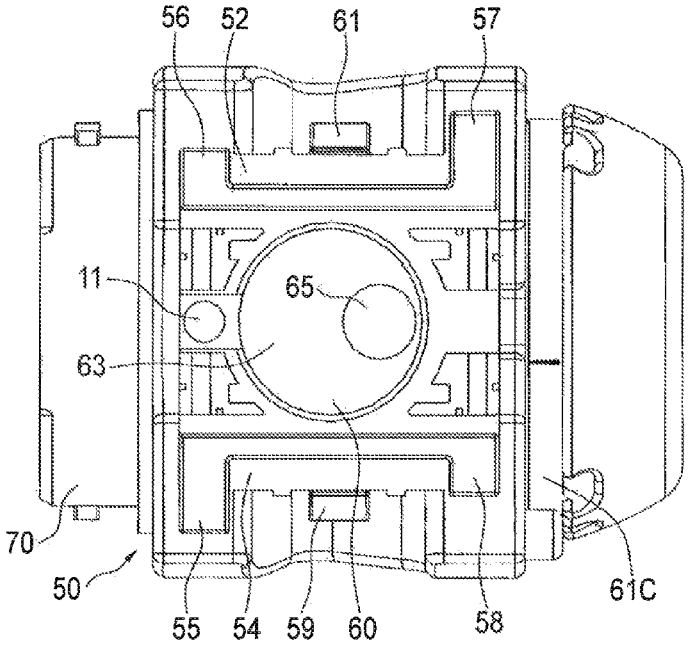
FIG. 12 is a side view of one side of the chamber housing assembly of the present invention.
Figure 13:
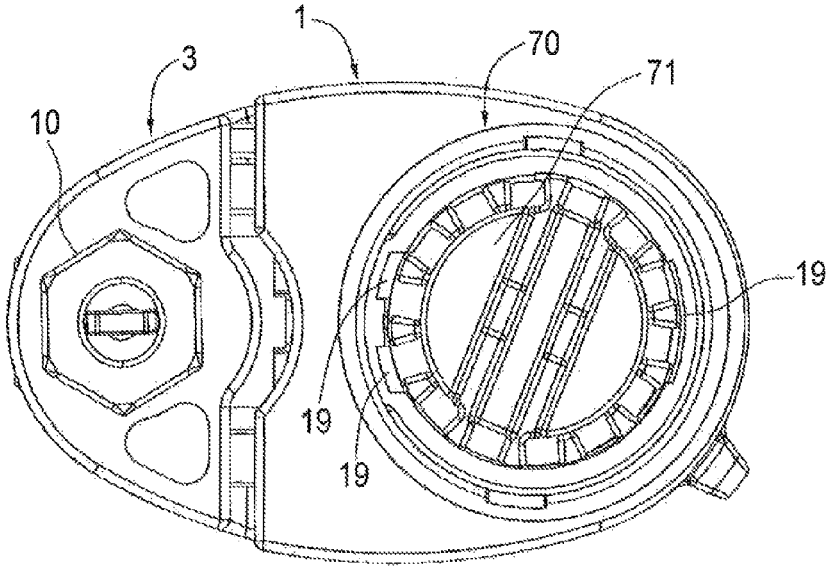
FIG. 13 is a top plan view of the chamber housing assembly.
Figure 14:
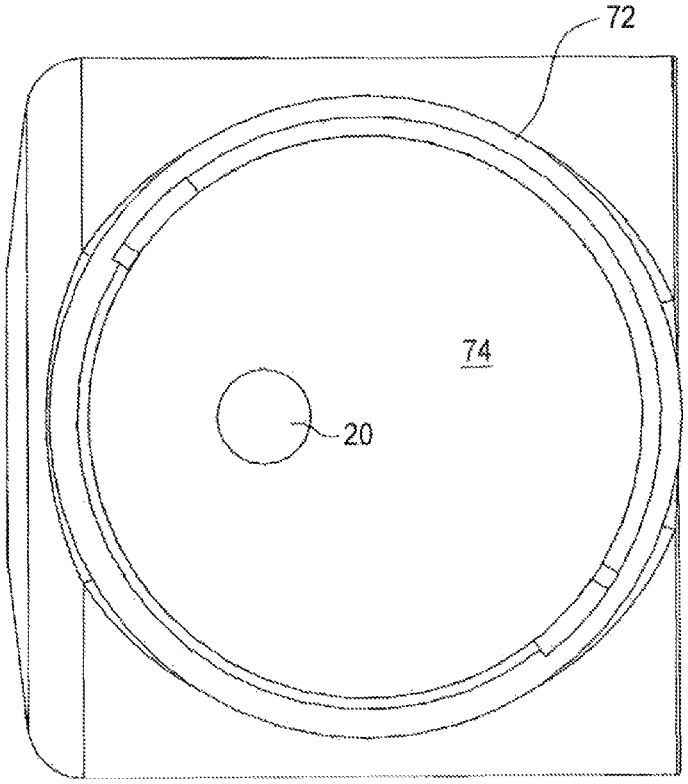
FIG. 14 is a bottom plan view of the horn housing assembly.

Still further, and now in more detail, the audible device includes a horn housing assembly 1, a chamber housing assembly 2 and a coupler housing assembly 3, as indicated above. The coupling housing assembly is shown most clearly in FIGS. 1, 2, 4, 7, 10 and 11. The coupling assembly includes a female air coupler 10 to which is connected to the preexisting power inflater from the diver's scuba gear. The female air coupling 10 connects to an air passage 12. The coupling assembly also includes a male coupling 9 connected to a source of air from the diver's scuba tank. An illustration of the connection between a signaling device and a diver's scuba gear is shown in U.S. Pat. No. 4,950,102, the contents of which are hereby incorporated for reference. Extending from one side of the coupling assembly and in fluid communication with the air passage 12 is a valve 7 which is shown in a non-activated position in FIG. 2 and in one active position in FIG. 10. In the position of FIG. 2, no air escapes from air passage 12.

The valve 7 includes an elongated stem 30 with a small knob 38 at the proximal end thereof. Surrounding the valve 7 is a spring 34, the distal end of which is positioned in a forward open portion of a hollow cylinder 36 which forms a part of the coupling assembly. The spring 34 extends outwardly from the hollow cylinder. The coupling assembly includes a portion 35 with two extending arm portions 38 and 40. In use, the diver places a finger around portion 35. Four extending posts 42-45 are also present which generally are positioned at the corners of a square. The extending arms 38 and 40 and the posts 42-45 mate with the chamber housing assembly as discussed in more detail hereinafter. The coupling assembly also includes a flexible blocking element 39 in the form of a short rod, approximately $\frac{1}{8}^{th}$ inch long and $\frac{1}{8}^{th}$ inch in diameter which extends outwardly from the coupling member, located slightly above hollow cylinder 36. The flexible blocking member interacts with a portion of the chamber housing assembly as discussed below.

The chamber housing is shown in FIGS. 1, 2, 4, 6, 10, 12 and 13. The chamber housing assembly includes a side portion 50 (FIG. 12) which mates with the coupling assembly. The side portion 50 includes two opposing side slots 52 and 54 into which the two extending arms of the portion 35 of the coupling assembly fit, as well as four openings 55-58 into which the four posts 42-45 from the coupling assembly fit. The side portion also includes a central circular opening 60 which is approximately 0.35 inches deep and 0.60 inches in diameter, into which spring 34 from the coupling assembly fits. The interior surfaces of the extending arms 38, 40 from the coupling assembly include openings, which mate with extending latch elements 59 and 61 at the surface of slots 52, 54. This arrangement holds the coupling assembly to the chamber assembly. To separate these two assemblies, a small screwdriver or similar implement can be used to pry off the flexible arms from the latch elements. The openings in the extending arms are long enough to permit the coupling assembly to be moved in the direction of the housing chamber assembly by user action on portion 35, against the action of spring 34. The spring 34 holds the coupling assembly relative to the housing chamber is such a relationship that no air escapes from the air passage 12 when the portion 35 is not operated, i.e. valve 7 is closed.

Opening 60 terminates in a surface 63 which has a small opening 65 in fluid connection with a hollow interior of the chamber assembly in which is mounted a bi-stable piston 5. At the lower end of the hollow interior, adjacent the lower end of the piston is a diaphragm 8. In operation, the bi-stable piston is moved repeatedly within the chamber when the device is in the mode for producing underwater signaling in the form of a buzzing sound, as discussed further below.

Near the top of chamber 5 is an exhaust air passage 11 which extends from the chamber 5 toward the coupling housing. At the top of the chamber assembly 2 is a circular connecting assembly 70 which is approximately ¼-inch high in the embodiment shown. Positioned in the upper solid surface 71 of the connecting assembly 70 are several small spaced air passages 19 which in the embodiment shown are slots located at approximately the periphery of the connecting assembly, shown generally opposing each other, with two slots opposing a single slot in the embodiment shown.

Figure 15:
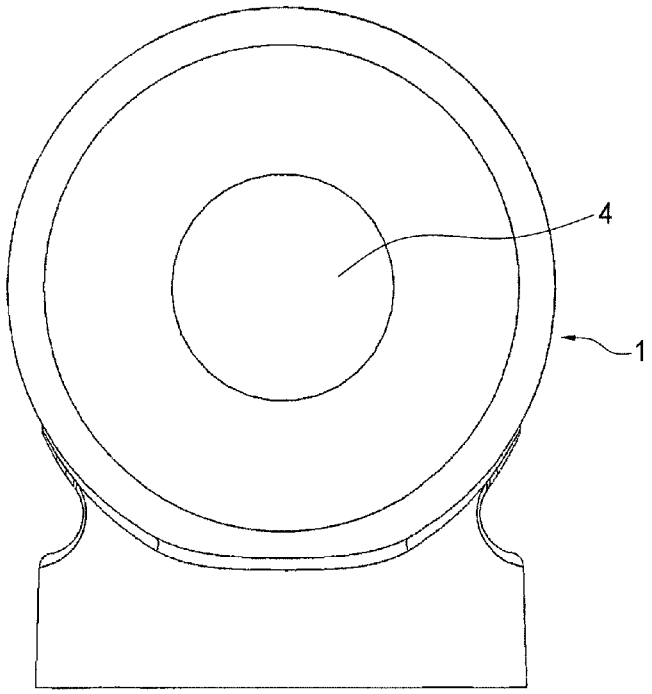
FIG. 15 is a rear elevational view of the horn housing assembly.

The horn housing assembly, shown in FIGS. 1, 2, 5, 10, 14 and 15, includes a connecting wall 72 which releasably mates with the connecting assembly 70 of the chamber housing. The horn assembly can be readily removed from the chamber assembly, since the interior surface of the connecting wall of the horn assembly mates with a bayonet lock with the exterior surface of the connecting assembly 70 of the chamber assembly. The connecting wall terminates in a surface 74, which includes an opening 20 which is in fluid connection with a rear surface diaphragm. Horn assembly 1 includes a horn surface 76 which curves outwardly, as shown in FIGS. 1 and 2, from an interior rear end edge thereof. At the rear end of the horn surface is surface horn diaphragm 4, as shown in FIG. 15. The horn assembly, when actuated, makes a loud noise to audibly signal others on the water surface, as discussed further below. The horn assembly is also designed to purge water from the surface thereof when air under pressure is admitted to it in addition to creating a loud audible alarm.

Referring now to FIGS. 2, 10, 14 and 15, the diver operates the device by grasping it, such that a finger, for instance the index finger, is positioned around and against the portion 35. FIG. 2, as indicated above, shows portion 35 and valve 7 in a non-operated or inactive position. There is no movement of air from passage 12 in this inactive position of the coupling housing assembly and the chamber housing assembly. The diver moves the switch to a first operating position by squeezing the coupling assembly and the chamber assembly together against the action of spring 34. In this position, air moves from the female air connection 10 through air passage 12, and through a connecting passage defined by the inner surface of hollow cylinder 36 as it fits into opening 60 in a fluid-tight relationship. Air moves through opening 65 into chamber 5, operating on bi-stable piston 6, causing it to rapidly strike percussion diaphragm 8, creating a buzzing sound underwater which alerts other divers to a possible issue. The incoming air in chamber 5 is continually exhausted through air passage 11 to the environment external of the appliance.

The diver can squeeze the coupling housing assembly and the chamber housing assembly further together to a second position. In this position, the exhaust air passage 11 from the chamber assembly is blocked by a rubber rod 39 which now is positioned into air passage 11. With exhaust passage 11 blocked, the air in chamber 5 moves up through openings 19 in the top of the chamber housing assembly. The air then moves through opening 20 in the horn creating a buildup of air under pressure that causes diaphragm 4 to flex outwardly, allowing air to escape. The quick flexing diaphragm makes a loud horn noise.

The chamber assembly includes a rotatable lock ring (61A in FIGS. 6 and 12 and 13 in FIG. 3) which rotates through a small angle by user action on an extending tab 61B. In one position, a portion 61C on the side of 61A opposing tab 61B will contact an extending element 61D on the coupling assembly preventing any relative movement of the coupling assembly and the chamber assembly and inadvertent activation. When the locking ring is rotated to a second position, the portion 61C is moved out of the way of element 61D, permitting activation of the device.

Hence, a diver's alarm device has been disclosed which includes a two-position squeeze/switch arrangement between a coupling housing assembly and a chamber housing assembly to provide both an above-surface and a sub-surface alarm capability.

Although a preferred embodiment has been disclosed for purposes of illustration, it should be understood that various changes and modifications and substitutions could be made in the preferred embodiment without departing from the spirit of the invention as defined by the claims which follow:

What is claimed is:

1. An audible alarm device for divers, comprising:

a coupling assembly having an inlet for connecting to a source of air from a diver's air tank, the coupling assembly further including an air valve which when operated permits air under pressure to move from an outlet in the coupling assembly through a valve channel; and a chamber assembly having an internal chamber, an opening to the internal chamber to receive the valve channel of the coupling assembly, a bi-stable piston and a percussion diaphragm mounted to the internal chamber, the chamber assembly having an exhaust channel which connects the internal chamber to the exterior of the device, wherein when the coupling assembly and the chamber assembly are moved to a first relative position, the air valve is opened, allowing air to move into the internal chamber of the chamber assembly, acting on the bi-stable piston to produce an underwater sound, and wherein when the coupling assembly and the chamber assembly are moved to a second, closer relative position, the exhaust channel is blocked, forcing the air in the internal chamber into air passages leading to a horn assembly which includes a horn diaphragm which produces an above surface noise in response to the air from the internal chamber when the device is above surface.

2. The audible alarm device of claim 1, wherein the coupling assembly and the chamber assembly are spring biased relative to each other.

3. The audible alarm device of claim 2, wherein in operation, the coupling housing member and the chamber housing member move toward each other against the action of the spring biased for the first and second relative positions.

4. The audible alarm device of claim 1, wherein the coupling assembly includes two opposing arms which extend around at least 50% of the circumference of the device.

5. The audible alarm device of claim 4, wherein the two opposing arms include slots in inner surfaces thereof which releasably receive latch members on mating surfaces of the chamber assembly.

6. The audible alarm device of claim 1, wherein the coupling assembly, the chamber assembly and the horn assembly are separable from each other.

7. The audible alarm device of claim 1, wherein the blocking member is a flexible nipple or rod on the coupling assembly which extends into the exhaust channel, blocking it when the coupling assembly and the chamber assembly are in their second relative position.

8. The audible alarm device of claim 1, wherein the chamber assembly includes at least two air passages at the top thereof, the two air passages being in fluid communication with the internal chamber of the chamber housing assembly and with an opening in the horn assembly, which is in turn in fluid communication with a diaphragm at a rear end of the horn assembly.

9. The audible alarm device of claim 1, including a locking member which is movable around a portion of the exterior of the chamber housing assembly, configured so that in a locked position, movement of the coupling assembly in the direction of the chamber housing assembly is prevented, thereby preventing activation of the alarm device.

* * * * *